US007607926B2

(12) United States Patent
Wang

(10) Patent No.: US 7,607,926 B2
(45) Date of Patent: Oct. 27, 2009

(54) CONNECTOR WITH A SWITCH TERMINAL

(75) Inventor: Hsu-Fen Wang, Hsin-Tien (TW)

(73) Assignee: Advanced Connectek Inc., Hsin-Tien, Taipei Hsien (TW)

( * ) Notice: Subject to any disclaimer, the term of this patent is extended or adjusted under 35 U.S.C. 154(b) by 0 days.

(21) Appl. No.: 12/254,666

(22) Filed: Oct. 20, 2008

(65) Prior Publication Data

US 2009/0233473 A1 Sep. 17, 2009

(30) Foreign Application Priority Data

Mar. 14, 2008 (TW) ..... 97204417 U

(51) Int. Cl.
*H01R 29/00* (2006.01)

(52) U.S. Cl. ..... 439/188; 439/630; 439/608; 200/51.1

(58) Field of Classification Search ..... 439/188, 439/157, 608, 630; 200/51.1
See application file for complete search history.

(56) References Cited

U.S. PATENT DOCUMENTS 4,948,376 A * 8/1990 Penning ..... 439/188
6,382,993 B1 * 5/2002 Chen ..... 439/157
6,551,115 B1 * 4/2003 Li et al. ..... 439/79
6,692,277 B2 * 2/2004 Hu et al. ..... 439/188
6,764,327 B2 * 7/2004 Yu ..... 439/188
7,438,600 B1 * 10/2008 Hung et al. ..... 439/630

* cited by examiner

*Primary Examiner*—Truc T Nguyen
(74) *Attorney, Agent, or Firm*—patenttm.us

(57) ABSTRACT

A connector has an insulative housing, a plurality of terminals, switch terminal and a metal shell. The insulative housing has a base and a tongue. The base has a slit and an open slot communicating with the slit. The terminals are mounted in the base and the tongue of the tongue. The switch terminal is mounted in the slit and the open slot and has a mounting section, a contacting section and a soldering section. The mounting section is mounted securely in the slit. The contacting is mounted movably in the open slot. The metal shell covers the insulative housing. With the switch terminal, the connector is capable of activating and deactivating a circuit on a PCB for signal and power transmission depending whether a corresponding plug connector plugged into the connector.

8 Claims, 9 Drawing Sheets

CONNECTOR WITH A SWITCH TERMINAL

BACKGROUND OF THE INVENTION

1. Field of the Invention

The present invention relates to a connector, and more particularly to a connector with a switch terminal that complies with the Universal Serial Bus (USB) standard or High Definition Multimedia Interface (HDMI) standard.

2. Description of Related Art

Conventional receptacle and plug connectors complying with Universal Serial Bus (USB) or High Definition Multimedia Interface (HDMI) standards have an insulative housing, a plurality of terminals and a metal shell. The metal shell covers the insulative housing and shields the terminals to prevent external electromagnetic interference and has a grounding function.

However, the conventional receptacle/plug connectors do not have any switches selectively contacting a corresponding plug/receptacle connector to activate a circuit that proceeds with signal and power transmission.

To overcome the shortcomings, the present invention provides a connector with a switch terminal to mitigate or obviate the aforementioned problems.

SUMMARY OF THE INVENTION

The main objective of the invention is to provide a connector with a switch terminal that complies with the Universal Serial Bus (USB) standard or High Definition Multimedia Interface (HDMI) standard.

A connector in accordance with the present invention comprises an insulative housing, a plurality of terminals, switch terminal and a metal shell. The insulative housing has a base and a tongue. The base has a slit and an open slot communicating with the slit. The terminals are mounted in the base and the tongue of the tongue. The switch terminal is mounted in the slit and the open slot and has a mounting section, a contacting section and a soldering section. The mounting section is mounted securely in the slit. The contacting is mounted movably in the open slot. The metal shell covers the insulative housing. With the switch terminal, the connector is capable of activating and deactivating a circuit on a PCB for signal and power transmission depending whether a corresponding plug connector plugged into the connector.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
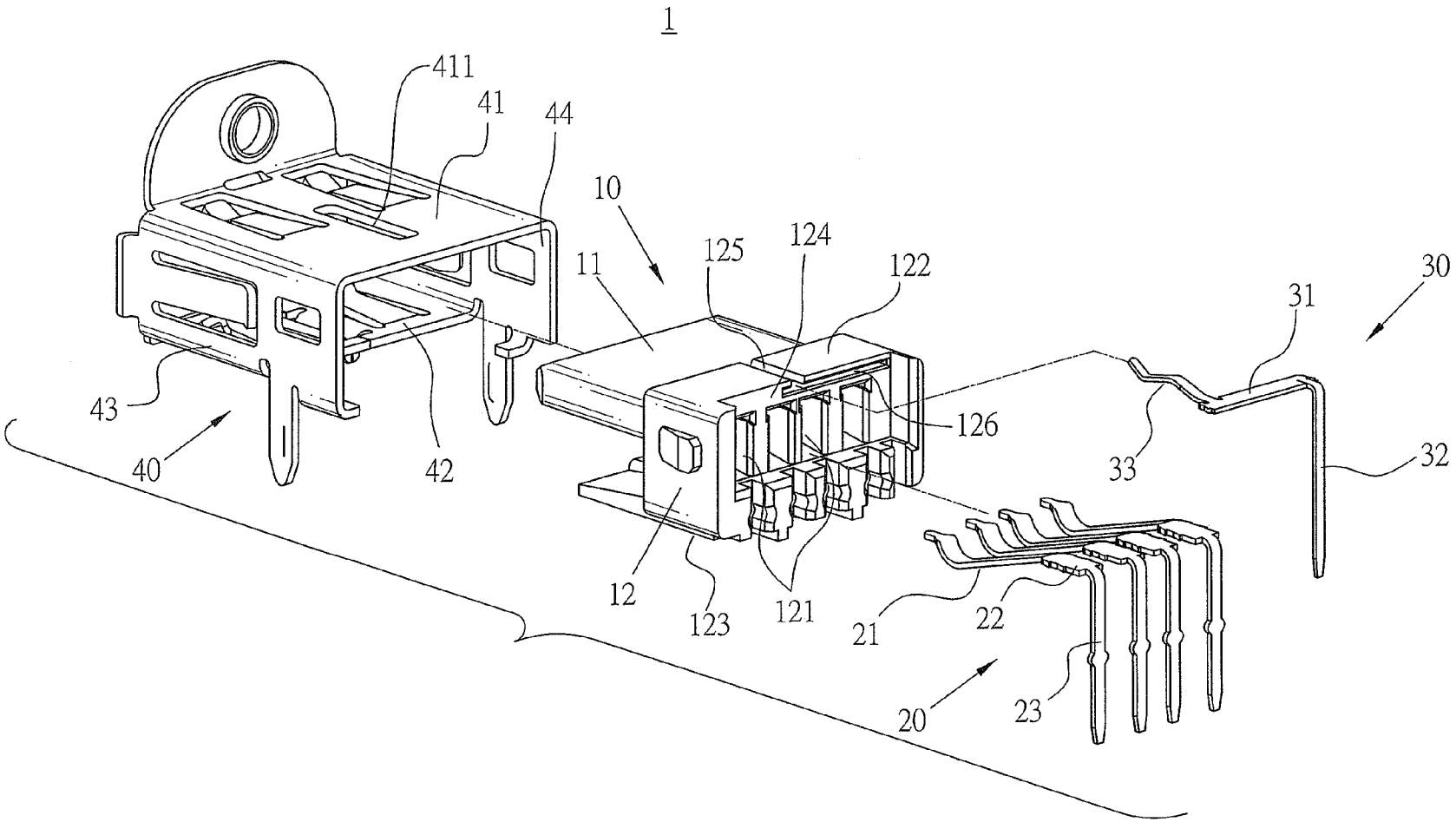
FIG. 1 is an exploded perspective view of a first embodiment of a connector with a switch terminal in accordance with the present invention.
Figure 2:
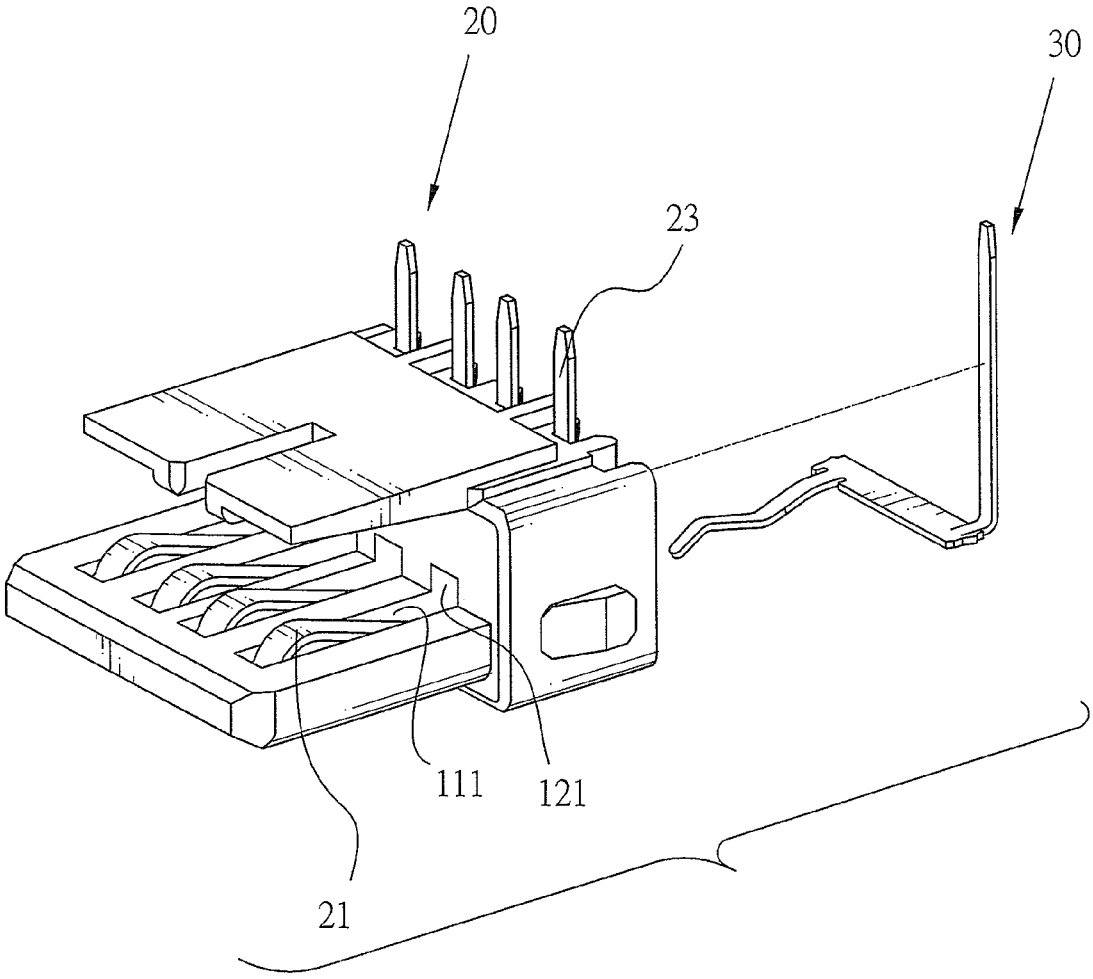
FIG. 2 is a partially exploded front perspective view of the insulative housing, the terminals and the switch terminal of the connector in FIG. 1.

With reference to FIGS. 1 and 2, a first embodiment of a connector (1) in accordance with the present invention may be a receptacle connector and may comply with Universal Serial Bus (USB) standard. The connector (1) comprises an insulative housing (10), a plurality of the terminals (20), a switch terminal (30) and a metal shell (40).

The insulative housing (10) has a base (12) and a tongue (11).

The base (12) has a front, a rear (124), a top (122), a bottom (123), a plurality of mounting holes (121), an open slot (125) and a slit (126). The mounting holes (121) are defined through the base (12) from the rear (124) to the front. The open slot (125) is defined longitudinally in the top (122), extends from the rear (124) to the front and has two open ends respectively at the front and the rear (124). The slit (126) is defined in the rear (124) and communicates with the open slot (125).

The tongue (11) is formed on and protrudes forwards from the front of the base (12) and has a top, a bottom and a plurality of mounting grooves (111). The mounting grooves (111) are defined longitudinally in the bottom of the tongue (11) and correspond respectively to and communicate respectively with the mounting holes (121).

The terminals (20) are mounted respectively through the mounting holes (121) of the base (12), are mounted respectively in the mounting grooves (111) in the tongue (11) and each terminal (20) has a mounting portion (22), a resilient arm portion (21) and a soldering portion (23).

The mounting portion (22) is mounted securely in one mounting hole (121).

The resilient arm portion (21) is formed on and protrudes forwards from the mounting portion (22), is mounted in one mounting groove (111) and may contact one of terminals on a corresponding plug connector to implement the signal and power transmission.

The soldering portion (23) is formed on and protrudes substantially perpendicularly downwards from the mounting portion (22) and may be soldered on a printed circuit board (PCB) to securely hold the connector (1) on the PCB.

Figure 3:
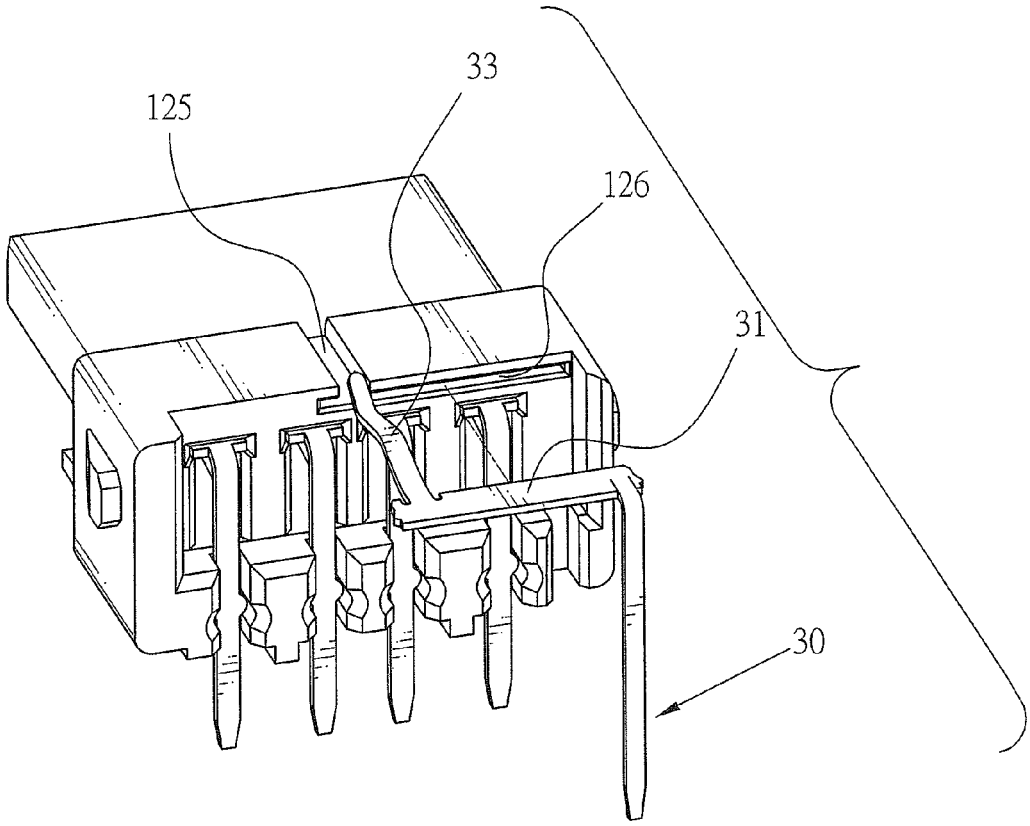
FIG. 3 is a partially exploded rear perspective view of the insulative housing, the terminals and the switch terminal of the connector in FIG. 1.
Figure 4:
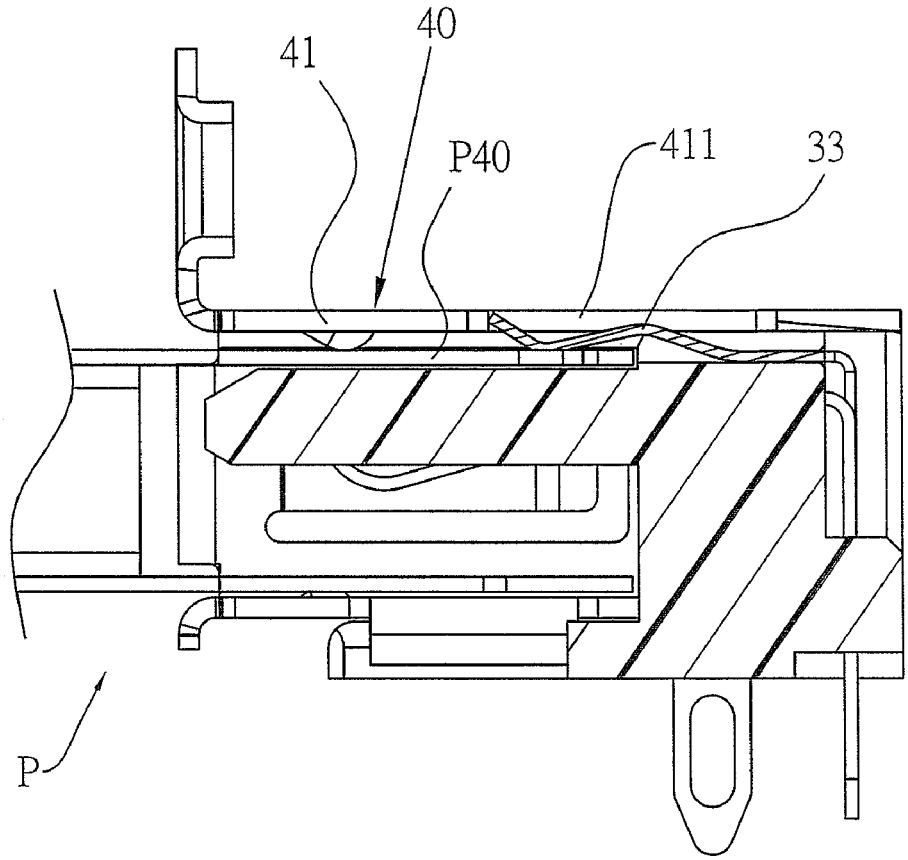
FIG. 4 is an operational cross sectional side view of the connector in FIG. 1 engaged with a corresponding plug connector.

With further reference to FIGS. 3 and 4, the switch terminal (30) is mounted and embedded in the base (12) of the insulative housing (10). The switch terminal (30) may electrically contact a metal shield (P40) of a corresponding plug connector (P) to activate a circuit on the PCB to proceed with signal and power transmission. The switch terminal (30) has a mounting section (31), a contacting section (33) and a soldering section (32).

The mounting section (31) is mounted securely in the slit (126) and has two ends.

The contacting section (33) is resilient, is formed on and protrudes substantially perpendicularly from one end of the mounting section (31), is mounted longitudinally and movably in the open slot (125), selectively extends upwards out of the open slot (125) and is located above the top of the tongue (11).

The soldering section (32) is formed on and protrudes substantially perpendicularly downwards from the other end of the mounting section (31) and may be soldered on the PCB and connected to the circuit so that the switch terminal (30) is connected electrically to the circuit.

Figure 5:
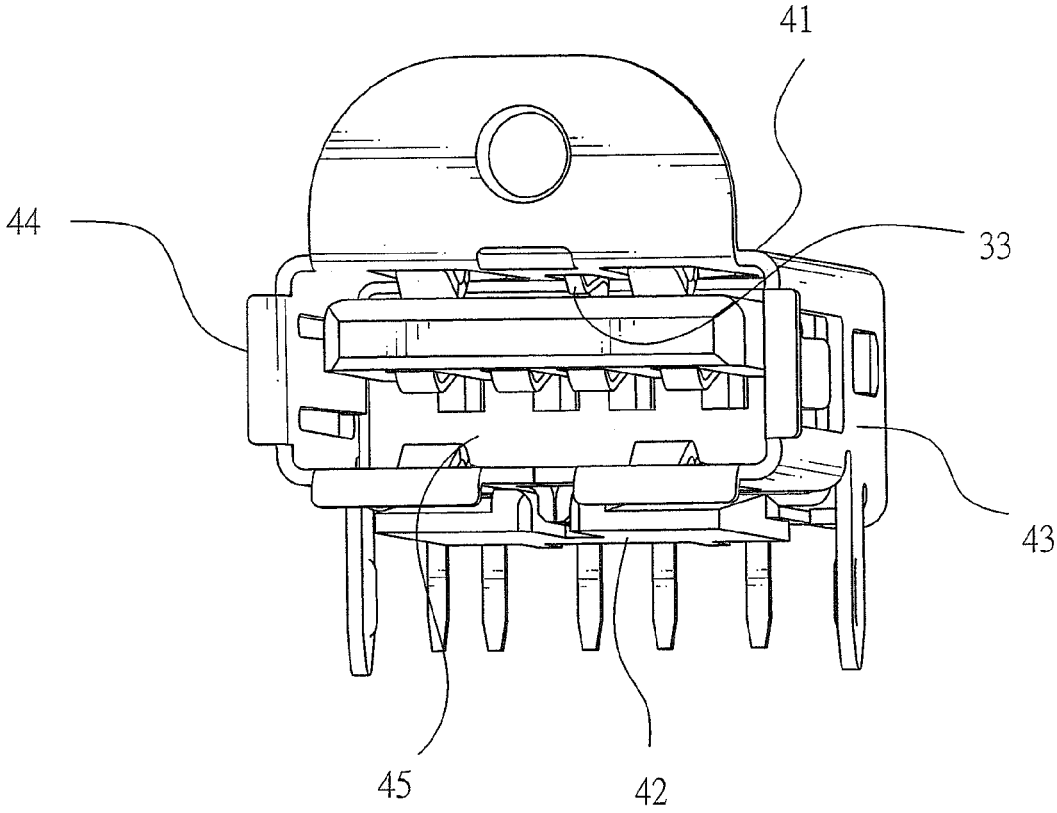
FIG. 5 is a perspective view of the connector in FIG. 1.
Figure 6:
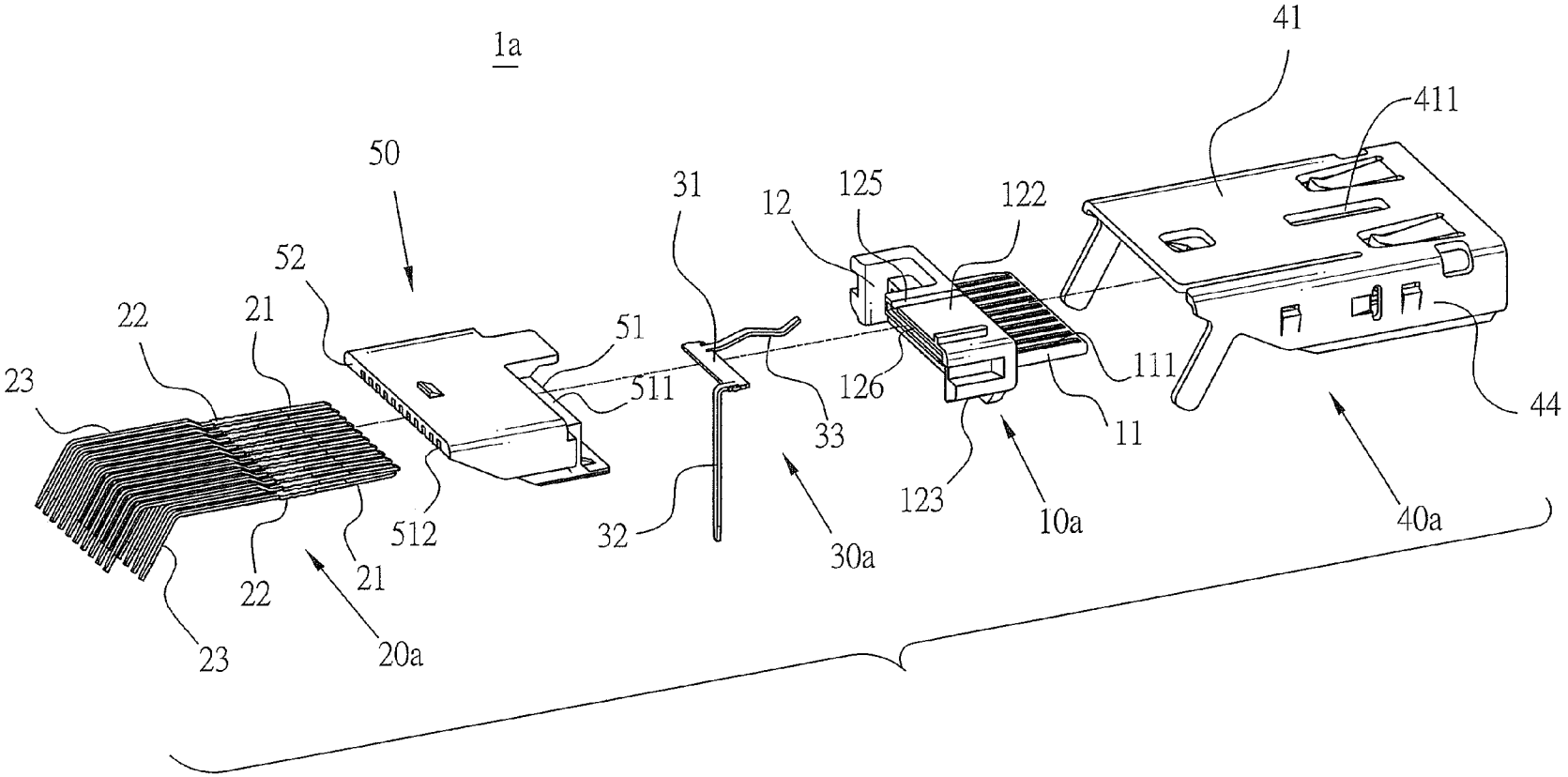
FIG. 6 is an exploded perspective view of a second embodiment of the connector in accordance with the present invention.
Figure 7:
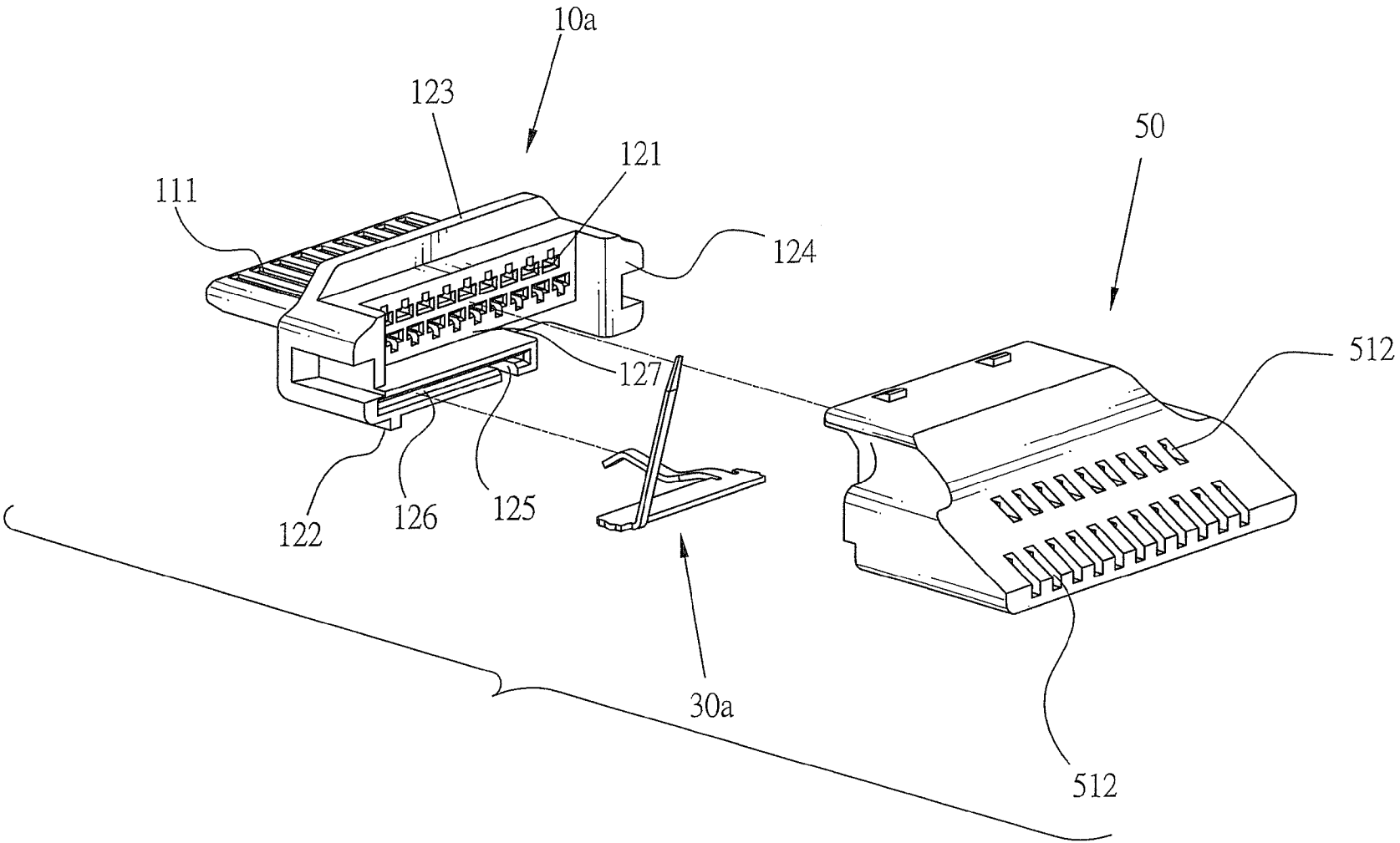
FIG. 7 an exploded perspective view of the insulative housing, the terminal distribution bracket and the switch terminal of the connector in FIG. 6.
Figure 8:
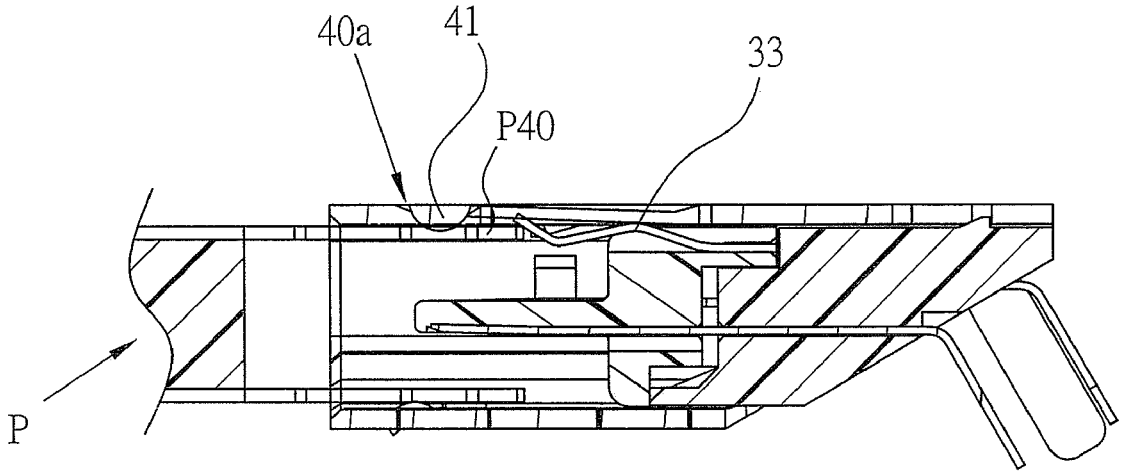
FIG. 8 is an operational cross sectional side view of the connector in FIG. 6 engaged with a corresponding plug connector.
Figure 9:
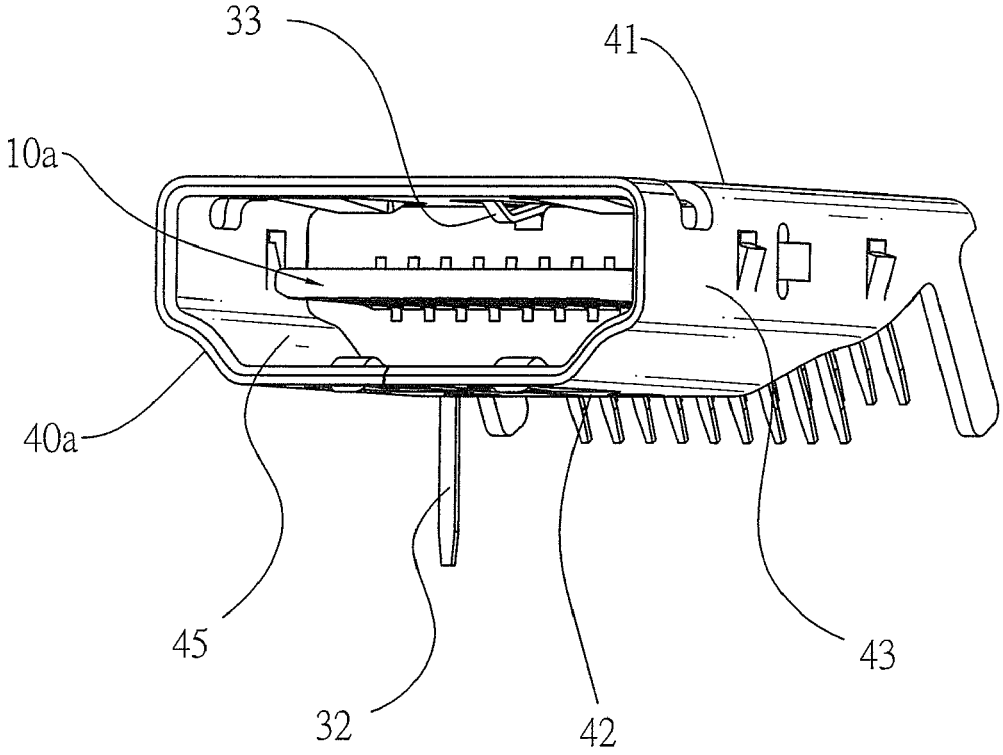
FIG. 9 is perspective view of the connector in FIG. 6.

With further reference to FIG. 5, The metal shell (40) is hollow, covers the insulative housing (10) and is separated from the switch terminal (30). The insulative housing (40) has a top plate (41), a bottom plate (42), two opposite side plates (43, 44), a socket (45) and a slot (411).

The top plate (41) is located above the contacting section (33) of the switch terminal (30).

The socket (45) is defined by the top plate (41), the bottom plate (42) and the side plates (43, 44) and through the metal shell (40) and may receive the corresponding plug connector.

The slot (411) is defined through the top plate (41), communicates with the socket (45) and selectively receives the contacting section (33) of the switch terminal (30). When the corresponding plug connector (P) is engaged with the receptacle connector (1) of the present invention, the metal shield (P40) of the corresponding plug connector (P) extends into the socket (45). Atop board of the metal shield (P40) is located between the tongue (11) and the contacting section (33) of the switch terminal (30) and contacts the metal shell (40) and the switch terminal (30). Therefore, the switch terminal (30) is connected electrically to the metal shell (40) through the metal shield (P40) to activate the circuit on the PCB. The activated circuit starts the signal and power transmission between the receptacle connector (1) and the plug connector (P).

When the connector (1) is fabricated, the terminals (20) extend respectively through the mounting holes (121) into the mounting grooves (111) of the insulative housing (10). Then the switch terminal (30) is mounted into the slit (126) and the open slot (125). The metal shell (40) covers the insulative housing (10).

With reference to FIGS. 6 to 9, a second embodiment of a connector (1*a*) in accordance with the present invention is similar to the first embodiment and may be receptacle connector and may comply with High Definition Multimedia Interface (HDMI) standard. The connector (1*a*) comprises an insulative housing (10*a*), a plurality of the terminals (20*a*), a switch terminal (30*a*) and a metal shell (40*a*) and further comprises a terminal distribution bracket (50).

The insulative housing (10*a*), terminals (20*a*), switch terminal (30*a*) and metal shell (40*a*) are similar to those of the first embodiment.

The base (12) of the insulative housing (10*a*) further has a recess (127). The recess (127) is defined in the rear (124) of the base (12) and is located under the slit (126).

The soldering portion (23) of each terminal (20*a*) is L-shaped.

The terminal distribution bracket (50) is mounted securely on the rear (124) of the base (12) of the insulative housing (10*a*), holds the switch terminal (30*a*) between the insulative housing (10*a*) and the terminal distribution bracket (50) and has a front surface (51), a rear surface (52), a mounting protrusion (511) and two rows of terminal holes (512).

The front surface (51) abuts tightly against the rear (124) of the base (12) of the insulative housing (10*a*) and closes the slit (126) so that the switch terminal (30*a*) is mounted securely between the insulative housing (10*a*) and the terminal distribution bracket (50).

The mounting protrusion (511) is formed on and protrudes forwards from the front surface (51) of the terminal distribution bracket (50) and is mounted securely in the recess (127) in the rear (124) of the base (12).

The terminal holes (512) are defined through the terminal distribution bracket (50), correspond respectively to the mounting holes (121) of the base (12) and respectively receive and hold the soldering portions (23) of the terminals (20*a*). The rows of the terminal holes (512) are located respectively in two different levels relative to the terminal distribution bracket (50) so that the soldering portions (23) of the terminals (20*a*) are divided into two sets respectively at an inside row and an outside row relative to the terminal distribution bracket (50).

The metal shell (40*a*) covers and securely holds the insulative housing (10*a*) and the terminal distribution bracket (50) together.

When the connector (1*a*) is fabricated, the terminals (20*a*) extend respectively through the mounting holes (121) into the mounting grooves (111) of the insulative housing (10*a*). Then the switch terminal (30*a*) is mounted into the slit (126) and the open slot (125). The terminal distribution bracket (50) is mounted on the rear (124) of the base (12) of the insulative housing (10*a*) and holds the switch terminal (30*a*). The metal shell (40) covers the insulative housing (10).

With the switch terminal (30, 30*a*) mounted in the insulative housing (10, 10*a*), the connector (1, 1*a*) of the present invention is capable of activating and deactivating the circuit on the PCB depending whether the corresponding plug connector (P) is engaged with the connector (1, 1*a*) or not.

Furthermore, the switch terminal (30, 30*a*) is embedded in the insulative housing (10, 10*a*) inside the metal shell (40, 40*a*) instead of protruding out of the metal shell (40, 40*a*). Therefore, the connector (1, 1*a*) is compact and may be installed easily into a portable electronic device such as a cellular phone.

Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A connector comprising:

an insulative housing having a base having a front, a rear, a top and a bottom and further having a plurality of mounting holes defined through the base from the rear to the front;

an open slot defined longitudinally in the top, extending from the rear to the front and having two open ends; and a slit defined in the rear and communicating with the open slot; and a tongue formed on and protruding forwards from the front of the base and having a top, a bottom and a plurality of mounting grooves defined longitudinally in the bottom of the tongue and corresponding respectively to and communicating respectively with the mounting holes;

a plurality of terminals mounted respectively through the mounting holes of the base, mounted respectively in the mounting grooves in the tongue and each terminal having a mounting portion mounted securely in one mounting hole;

a resilient arm portion formed on and protruding forwards from the mounting portion and mounted in one mounting groove; and a soldering portion formed on and protruding substantially perpendicularly downwards from the mounting portion;

a switch terminal mounted and embedded in the base of the insulative housing and having a mounting section mounted securely in the slit and having two ends;

a contacting section being resilient, formed on and protruding substantially perpendicularly from one end of the mounting section, mounted longitudinally and movably in the open slot, selectively extending upwards out of the open slot and located above the top of the tongue; and a soldering section formed on and protruding substantially perpendicularly downwards from the other end of the mounting section; and a metal shell being hollow, covering the insulative housing, separated from the switch terminal and having a top plate, a bottom plate, two opposite side plates and a socket defined by the top plate, the bottom plate and the side plates.

2. The connector as claimed in claim 1, wherein the top plate of the metal shell is located above the contacting section of the switch terminal.

3. The connector as claimed in claim 2, wherein the metal shell further has a slot defined through the top plate, communicating with the socket and selectively receiving the contacting section of the switch terminal.

4. The connector as claimed in claim 3, wherein the connector complies with the Universal Serial Bus (USB) standard.

5. The connector as claimed in claim 1 further comprising a terminal distribution bracket mounted securely on the rear of the base of the insulative housing, holding the switch terminal between the insulative housing and the terminal distribution bracket and having a front surface abutting tightly against the rear of the base of the insulative housing and closing the slit;

a rear surface;

a mounting protrusion formed on and protruding forwards from the front surface of the terminal distribution bracket and mounted securely in the recess in the rear of the base; and two rows of terminal holes located respectively in two different levels and the terminal holes defined through the terminal distribution bracket, corresponding respectively to the mounting holes of the base and respectively receiving and holding the soldering portions of the terminals.

6. The connector as claimed in claim 5, wherein the top plate of the metal shell is located above the contacting section of the switch terminal.

7. The connector as claimed in claim 6, wherein the metal shell covers and holds the insulative housing and the terminal distribution bracket together and further has a slot defined through the top plate, communicating with the socket and selectively receiving the contacting section of the switch terminal.

8. The connector as claimed in claim 7, wherein the connector complies with the High Definition Multimedia Interface (HDMI) standard.

* * * * *